US006732485B2

(12) United States Patent
Lett et al.

(10) Patent No.: US 6,732,485 B2
(45) Date of Patent: May 11, 2004

(54) METHOD AND DEVICE FOR STRUCTURAL REINFORCEMENT

(76) Inventors: Miles L. Lett, 788 Hollon Ave., Auburn, AL (US) 36830; Jorge del Valle, 356 Estate Ave., Auburn, AL (US) 36830

( * ) Notice: Subject to any disclaimer, the term of this patent is extended or adjusted under 35 U.S.C. 154(b) by 274 days.

(21) Appl. No.: 10/045,429

(22) Filed: Oct. 26, 2001

(65) Prior Publication Data

US 2003/0079435 A1 May 1, 2003

(51) Int. Cl.[7] ..... E04B 1/00

(52) U.S. Cl. ..... 52/742.13; 52/404.1; 222/386.5; 222/459

(58) Field of Search ..... 52/742.13, 404.1; 222/386.5, 459

(56) References Cited

U.S. PATENT DOCUMENTS 3,325,955 A 6/1967 Haut
4,062,165 A 12/1977 Marks et al.
4,285,183 A 8/1981 Condit
4,390,333 A 6/1983 Dubois
4,715,151 A 12/1987 Garblik
4,809,478 A 3/1989 Bernard
4,930,281 A 6/1990 Martin et al.
5,518,565 A 5/1996 Castellucci et al.
5,654,014 A 8/1997 Castellucci et al.
6,105,335 A * 8/2000 Vohra ..... 52/741.41

* cited by examiner

*Primary Examiner*—Carl D. Friedman
*Assistant Examiner*—Steve Varnet
(74) *Attorney, Agent, or Firm*—Bradley, Arant, Rose & White

(57) ABSTRACT

The present disclosure describes a device and method for the creation of a anchor points at any location in a wall through the injection of a curable anchor material into the cavity behind the wall. Once cured, the newly created anchor point will allow the wall to support heavy loads and undergo repeated stress over long periods of time without being damaged. The device of the present disclosure produces an anchor point that is at least as strong as the best methods currently available, yet is simpler and more economical to use than the methods currently available.

15 Claims, 5 Drawing Sheets

METHOD AND DEVICE FOR STRUCTURAL REINFORCEMENT

FIELD OF INVENTION

This disclosure relates generally to methods and devices for adding structural support to walls lacking sufficient structural support. Specifically, this disclosure relates to a device and method for inserting a curable material behind the surface of a wall to create an anchor point to a wall for providing additional structural support to the wall.

BACKGROUND

When attaching an article to a wall, either the wall itself must be capable of supporting the article, or the article must be attached so that it engages a supporting element behind the wall. This is especially true when the article is heavy, or the article is subject to repeated stresses. It is well know to most homeowners that in order to secure articles of significant weight, such as mirrors, pictures, shelves, light fixtures and the like, to a finished wall, the article must be secured to a frame stud behind the finished wall. In addition, articles that will undergo repeated stresses, such, as towel bars, cabinets, hooks and the like, must also be secured to a frame stud. If these articles are not secured to a frame stud, the articles may not remain secured to the wall, causing damage to the finished wall and possible injury to those nearby. In the case of most residential dwellings the frame studs are composed of wood. In other instances, the frame stud may be composed of aluminum or other metal. In either case, the frame studs are generally placed about 14 ½ inches apart in standard construction methods. As a result, in many cases there is not a frame stud available to secure an article in the selected location.

When this problem occurs, the options are to: 1) find an alternate location for the article where there is access to a frame stud; 2) insert a spring-loaded wingnut or similar device into the wall to secure the article to the wall; or 3) insert a blocking element, such as a section of wood, behind the wall to secure the article to the wall. Each of these options has advantages and disadvantages. Option number one, while being the simplest option, is not feasible in some instances as the article would not be functional in the alternate location, or would not have the desired aesthetic qualities in the alternate location. Options two and three allow the article to be placed in the desired location, but each suffers from its own drawbacks. The use of spring-loaded wingnuts or similar devices have the advantage that they are relatively simple to install, requiring only that a hole be drilled into the finished wall to receive the wingnut or other device. However, these devices do not provide a point of attachment of sufficient strength to secure heavy articles to the finished wall. In addition, over time, especially if the article is subject to repeated stress, the wingnut or other device will eventually cause damage to the sheet rock, or fail altogether. In such an instance, the finished wall may require extensive repairs to return it to its original condition. Option number three requires that the area behind the finished wall be "blocked," typically with a section of wood or other material secured between two existing frame studs on either side of the point of installation. In this case, the blocked section receives the article and secures the article to the wall. The blocking method has the advantage that it is capable of securely fastening heavy articles to the wall so that they can withstand repeated stresses over time, but suffers from the drawback that installation of the blocking element is very labor intensive, time consuming and expensive. For example, installation of a wood block behind a finished wall made of sheet rock requires making a hole in the sheet rock wall large enough to expose the two frame studs on either side of the installation point, nailing the wood block to each frame stud, applying new sheet-rock to the hole created, applying mud to the new section of sheet rock, sanding the newly applied mud, applying a second coat of mud, re-sanding, priming the new sheet rock section and applying new paint or wall paper to the new finished wall section. If the finished wall is made of plaster or other material, the process may even be more involved.

As can be seen from the above discussion, a device and method are needed for adding structural support to a wall, such that the reinforced wall is able to securely receive heavy loads and stresses without failing or becoming damaged over time. The device and method should be simple to use and install, economical and provide at least as much strength as current alternatives, such as blocking with wood.

SUMMARY

The present disclosure describes a device and method for the creation of anchor points at any point in a wall through the application of a curable anchor material. The anchor material is injected behind the wall and allowed to cure. Once cured, the newly created anchor point will allow the wall to support heavy loads and undergo repeated stress without being damaged.

The device of the present disclosure is in its most general form a bladder, with openings, or adhesion points, therein which is packaged in a deflated state in a protective housing. The bladder is fluidly connected to a source of anchor material by a connecting means. Once the device is inserted behind the wall, the device is ready for use. On activation of the device, anchor material is dispensed from the source into the bladder through the connecting means. The anchor material is metered to expand the bladder beyond its capacity, causing the anchor material to be extruded through the adhesion points on the bladder into the space behind the wall. The anchor material adheres to everything it contacts, and creates a structural anchor point capable of securing heavy articles such that they can withstand repeated stress over time. After the anchor material has set (usually 10–30 minutes), the protruding portion of the device is snapped off at a pre-engineered breakpoint so that the portion of the device remaining is flush with the outer wall.

The anchor material may be any single or multi-component system, such as polyesters, or other high density structural foams with the necessary cured physical properties to handle heavy loads and repeated stress over a long period of time, while meeting all building codes. The area of the anchor point will depend on the size of the bladder used, the amount of anchor material used and the wall space available. For typical household uses, the device will be engineered to create an anchor point from 4 to 16 inches in diameter.

DETAILED DESCRIPTION

Definitions

Figure 1A:
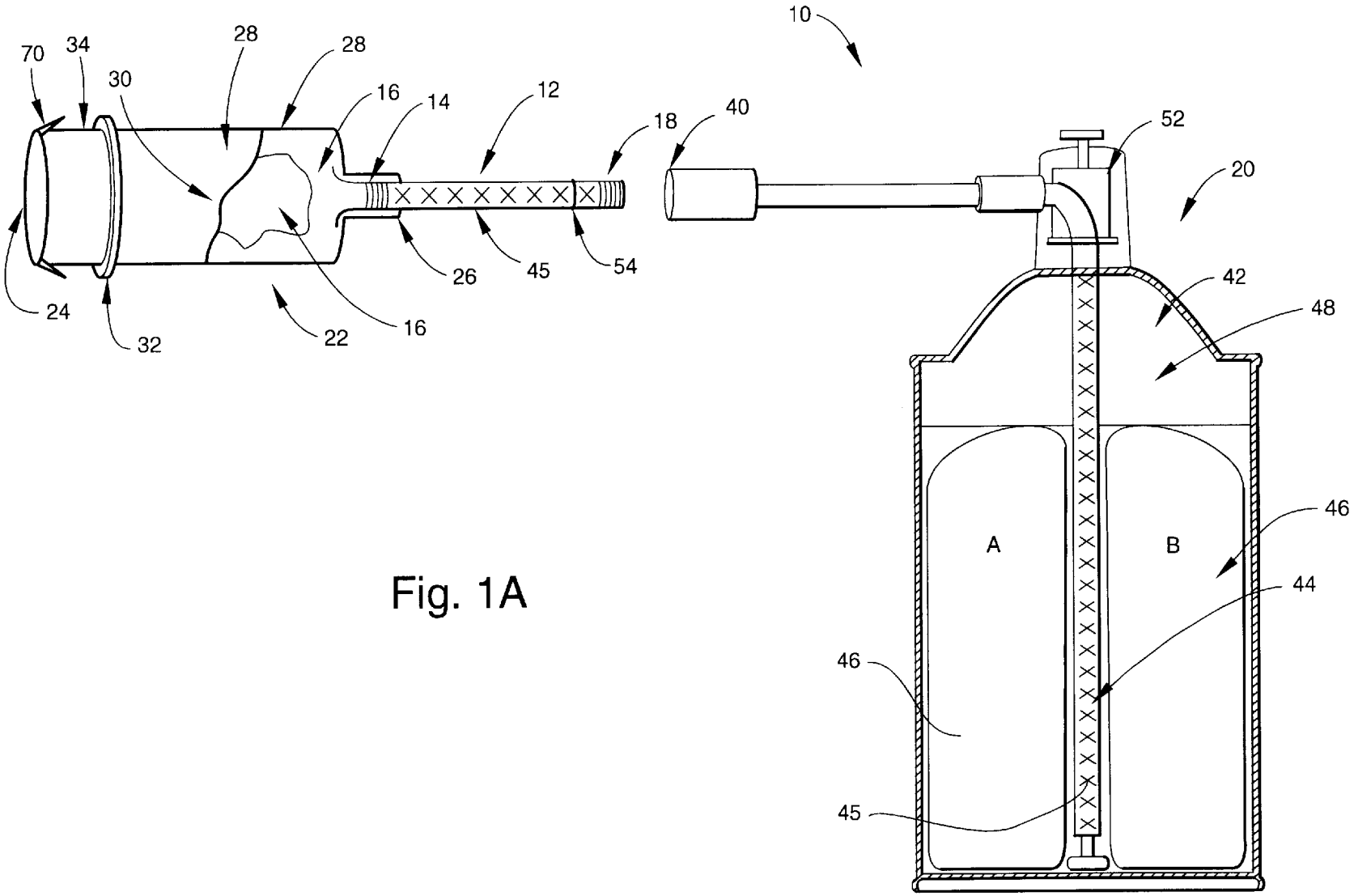
FIG. 1A is a side elevation view illustrating one embodiment of the device, with the device shown in its pre-activation state.

The following terms should be given the following meanings in this specification, the drawings and the claims that follow:

- anchor point shall mean the area of structural support created by the anchor material;
- article(s) shall mean any fixture, accessory, device, or other object that is capable of being secured to a wall;
- blocking shall refer to the process of adding additional support to the backside of a sheet rock panel or other surface which requires reinforcement;
- frame stud shall mean any structure, usually vertically oriented, regardless of composition that supports a wall;
- wall shall mean any surface, including, but not limited to, walls, ceilings, floors, decks and roofs, but shall not be restricted to flat planar surfaces;

The present disclosure is designed to overcome the deficiencies in the devices and methods currently available for blocking walls. The devices and methods currently available are either incapable of securing heavy articles to a wall for extended periods of time, or are too time consuming and expensive to be a viable option for the majority of users. The present disclosure describes a simple device for creating an anchor point behind any wall, so that the wall is able to support articles of significant weight and articles that are subject to repeated stresses. The device and method are simpler to use than current blocking methods, produce a reinforced area that is at least as strong as that produced by currently blocking methods and requires only about 10–30 minutes for installation.

Referring now to the drawings where like reference numerals have been used throughout the various figures to designate like items, FIGS. 1 and 2 illustrate two embodiment of the device of the present disclosure. Generally, the device comprises a source of anchor material fluidly connected to an inflatable bladder by a connecting means. The function of the source of anchor material is to maintain the anchor material and/or its components in a state so that upon activation of the source, the same can be delivered in a functional state to the bladder. The function of the connecting means is to provide a fluid connection between the source of anchor material and the bladder. The exact configuration of the source of the anchor material and the connecting means can be varied, with two embodiments shown below being for illustration of the overall concept of the present disclosure. FIGS. 1 and 2 show the device before activation.

Figure 1B:
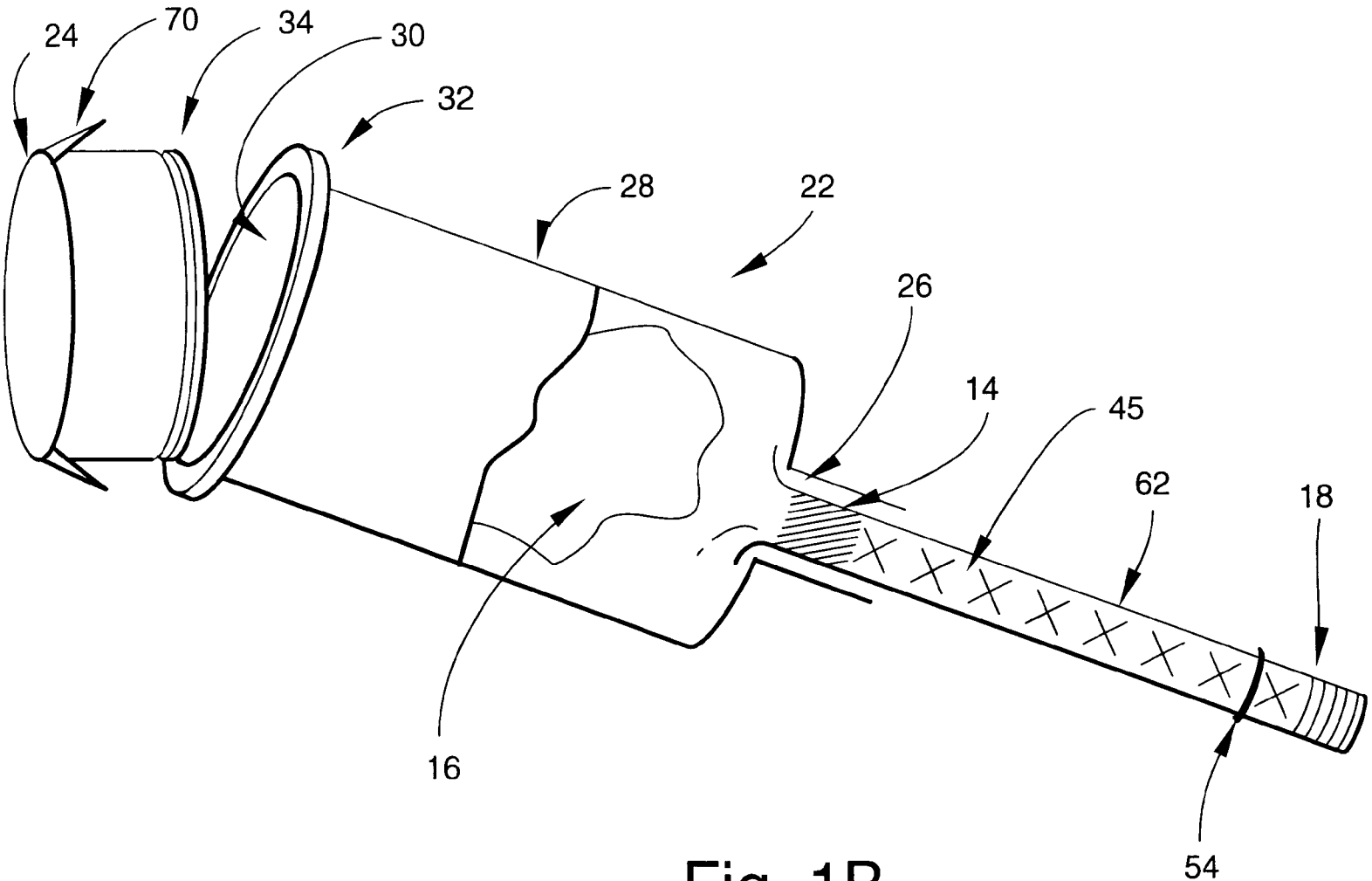
FIG. 1B is a side elevation view of the device shown in FIG. 1A further illustrating the housing and one embodiment of the breaking means.
Figure 3:
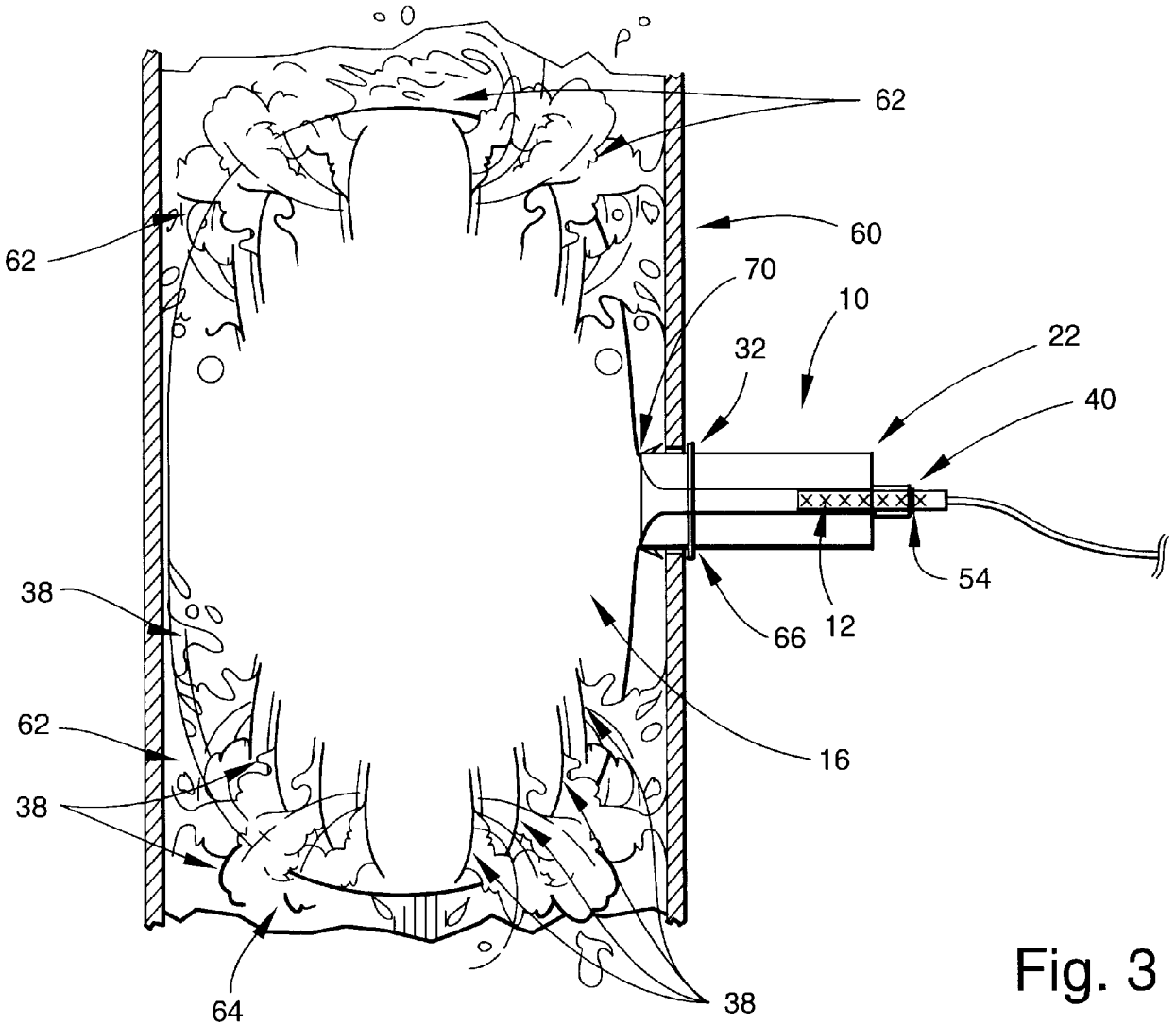
FIG. 3 is a side elevation view illustrating the embodiment of the device shown in FIG. 1A, with the device shown in its post-activation state.

FIGS. 1A and 1B illustrate one embodiment of the device. In this embodiment, the device 10 comprises a source of anchor material 20 and an inflatable bladder 16 and a connecting means comprising an insertion tube 12 fluidly connected to a discharge tube 44. The insertion tube 12 has a first end 14 and a second end 18, with the first end 14 secured to the bladder 16. The bladder 16 is attached to the first end 14 by any convenient means, such as a heat seal, a glue seal or a crimping seal. The insertion tube 12 is fluidly connected on its second end 18 to the discharge tube 44. The connection may be by any convenient means, such as a standard male/female threaded connection, a pressure connection, luer coupling, snap-fit coupling or bayonet coupling. FIG. 1A shows the connection made by virtue of a standard male/female threaded connection 40. The insertion tube 12 and discharge tube 44 may also contain static mixing elements 45 to ensure the anchor material remains mixed during transit from source 20 to bladder 16. In addition, the insertion tube 12 may have a stop 54 extending at along at least a portion of the circumference of the insertion tube 12. As shown in FIGS. 3 and 3B, the insertion tube 12 is inserted into the cavity 30 and pushes the bladder 16 out the first end 24 of the housing 22 and into the interior 64 of the wall 60. The stop 54 on the second end 18 of the insertion tube stops the inward motion of the insertion tube 12, and prevents damage to bladder 16.

The bladder 16 and the first end 14 are preferably contained, at least partially, within a protective housing 22. The exact configuration of the housing is not critical, but the overall area of the housing should be as compact as possible. As shown in FIGS. 1A and 1B, the 40 housing is illustrated as being generally circular in shape. In FIGS. 1A and 1B, the housing 22 comprises a sealed, frangible first end 24 and an open second end 26, the ends connected by a circular outer wall 28. The first end 24, the second end 26 and the outer wall 28 defined a cavity 30 to receive at least part of the bladder 16. The open second end 26 functions to receive the first end 14 of the insertion tube 12, and may be tapered to snugly receive the first end 14. In addition, the outer wall 28 further comprises a stop 32 extending around at least a portion of the periphery of the outer wall 28. The stop 32 can be located at various positions along the outer wall 28, but it is preferred that the stop 32 be placed so that the first end 24 extends at least partially into cavity 64 (shown in FIG. 3). The location of the stop 32 can be varied as required. The stop 32 may be engineered to include notched wall sections 34 to allow the outer wall 28 to be separated into 2 pieces at the location of the notched wall sections 34. The notched wall sections 34 are preferably located immediately next to the stop 32 and on the side of the stop proximal to the first end 24. In addition, snap anchors 70 may be placed on the outer wall 28 on or near the first end 24. The snap anchors 70 are angled to allow the first end 24 of the device 10 to be inserted through the wall 60, but to engage wall 60 to prevent unintentional removal of the device 10 (shown in FIG. 3).

Figure 2A:
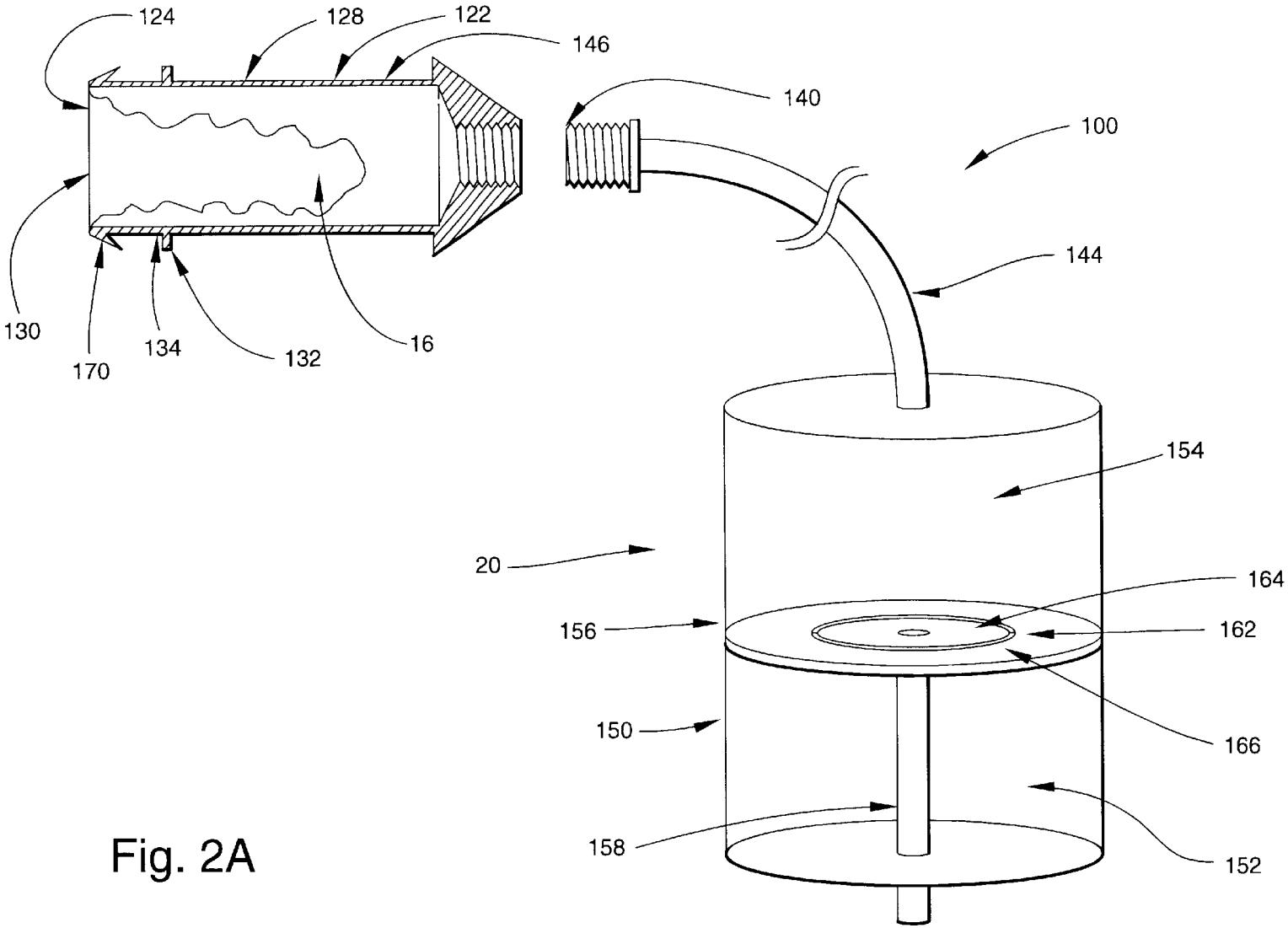
FIG. 2A is a side elevation view illustrating an alternate embodiment of the device, with the device shown in its pre-activation state.

In FIG. 2A, an alternate embodiment of the device is shown. While the device 100 comprises the basic elements of a source of anchor material 20, inflatable bladder 16 and a connecting means, the embodiments of these elements are different than that shown in FIGS. 1A and 1B. The device 100 comprises a protective housing 122. The housing 122 comprises a sealed, frangible first end 124 and a second end 146. The first end 124 and second end 146 are connected by a circular outer wall 128. The first end 124, the second end 146 and the outer wall 128 defined a cavity 130 to receive at least part of the bladder 16. The second end 146 has a connecting means adapted to receive a complementary connecting means on discharge tube 144. The connection may be by any convenient means, such as a standard male/female threaded connection, a pressure connection, luer coupling, snap-fit coupling or bayonet coupling. FIG. 2A shows the connection made by virtue of a standard male/female threaded connection 140. In addition, the outer wall 128 further comprises a stop 132 extending around at least a portion of the periphery of the outer wall 128. The stop 132 can be located at various positions along the outer wall 128, but it is preferred that the stop 132 be placed so that the first end 124 extends at least partially into cavity 64. The location of the stop 132 can be varied as required. The stop 132 may be engineered to include notched wall sections 134 to allow the outer wall 128 to be separated into 2 pieces at the location of the notch ed wall sections 134. The notched wall sections 134 are preferably located immediately next to the stop 132 and on the side of the stop proximal to the first end 124. The function and operation of the notched wall sections 134 is analogous to the function and operation of the notched wall sections 34 described above. In addition, snap anchors 170 may be placed on the outer wall 128 on or near the first end 124. The snap anchors 170 are angled to allow the first end 124 of the device 100 to be inserted through the wall 60, but to engage wall 60 to prevent unintentional removal of the device 100 (shown in FIG. 2A). The bladder 16 is secured to snap anchors 170 by any convenient means, such as a heat seal or a glue seal.

Referring to FIG. 3 which shows the embodiment of the device illustrated in FIGS. 1A and 1B after activation, the bladder 16 is generally spherical in shape and is composed of an elastic material (the principles described below and illustrated in FIG. 3 also applies to the embodiment illustrated in FIG. 2). Other shapes for the bladder 16 can be engineered if required for certain applications, such as rectangular blocks. The bladder 16 may contain a plurality of pre-engineered adhesion points 38 around the outer surface of the bladder 16. The adhesion points 38 are simply openings to allow the anchor material 62 to escape the bladder 16 and come into contact with structures behind the wall 60 when the device 10 is activated. The number of adhesion points 38 on bladder 16 can be varied to fit individual applications. The interior volume of the bladder 16 can be adjusted depending on the intended use of the device. For a typical use of providing an anchor point in a interior residential wall, the volume of the balloon is 65 inches$^3$ (in$^3$) to 400 in$^3$, preferably 230 in$^3$. This will produce a finished anchor point of 4 to 16 inches in diameter. The volume of the bladder 16, the diameter of the anchor point and the shape of the anchor point can be changed if desired.

Turning to a discussion of the source of anchor material 20, the source 20 delivers the anchor material 62, at sufficient speeds and pressure to the bladder 16 when the device 10 is activated. The pressure required on activation is dependent on the viscosity of the anchor material and its components, but is sufficient to ensure the anchor material is sufficiently mixed and dispensed into the inflatable bladder. The source 20, therefore, may be any means that meets these requirements. Preferably, the source 20 is self contained and is portable for ease of use.

FIG. 1A shows a standard aerosol can 42 as one embodiment of the source 20. The can 42 is of standard design, with a discharge tube 44 fluidly connected to at least one anchor material storage chamber 46 and a propellant chamber 48 at one end and the insertion tube 12 at the other. The end of the discharge tube 44 that connects to the insertion tube 12 may be flexible to facilitate ease of use. The activation means is shown in FIG. 1A as valve 52. On depression of valve 52, anchor material flows from the at least one storage chamber 46, through the discharge tube 44 and insertion tube 12 into the bladder 16.

Figure 2B:
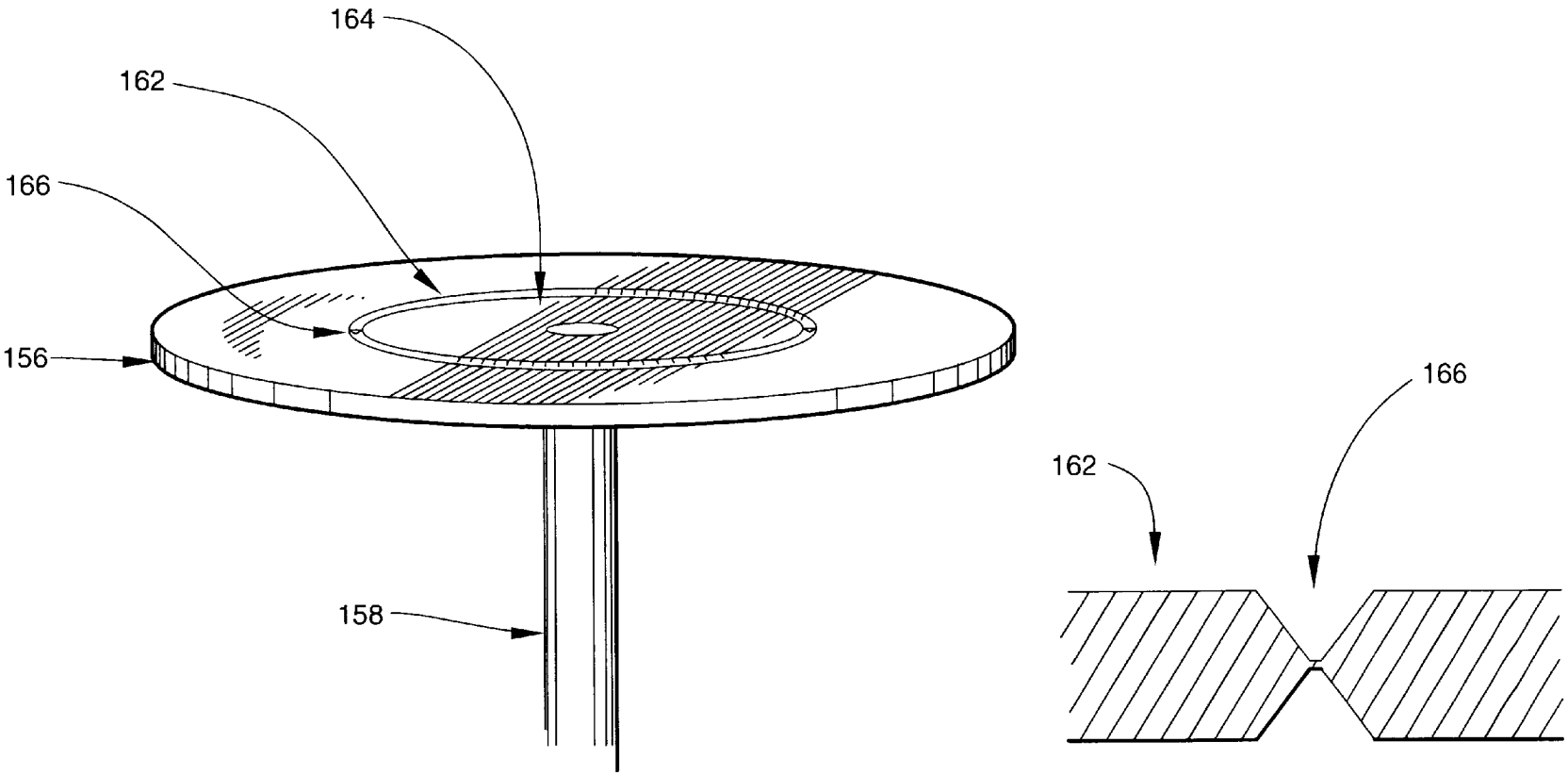
FIG. 2B is a side elevation view of the frangible inner ring illustrating one embodiment of the notched sections.

In an alternate embodiment shown in FIG. 2A, the source 20 is a container 150. The container 150 is separated into 2 compartments, 152 and 154 by a frangible separation means. The separation means functions to separate the components of the anchor material prior to activation, but can be ruptured when desired to allow the components of the anchor material to mix with one another. In FIG. 2A, the separation means comprises a planar O-ring 156 and a coupling shaft 158. The diameter of O-ring 156 is selected to conform to the diameter of container 150 and contains a frangible portion. The frangible portion comprises an inner ring 162 and a center portion 164, for connection to the coupling shaft. The inner ring 162 is constructed so that the seal integrity is compromised on rotation of coupling shaft 158. As illustrated in FIG. 2B, inner ring 162 may contain notched sections 166 for this purpose. The number and placement of notched sections 166 is not critical, with the embodiment shown in FIG. 2C illustrating 2 notched sections 166. The coupling shaft 158 extends beneath the container 150. The device is activated by rotating the coupling shaft 158 in either direction. The rotation breaks the inner rings 162 at notched sections 166, allowing the components of the anchor material stored in compartments 152 and 154 to interact and mix. On mixing, the components of the anchor material undergo a chemical reaction, forming a foam and expand in volume 3–5 fold. The expansion forces the anchor material through the discharge tube 144 and into the bladder 16, causing bladder 16 to expand. In this manner, the coupling shaft 158 serves as the activation means, with activation occurring on rotation of the activation shaft 158.

Although specific embodiments of the source 20 have been illustrated with specific embodiments of the connecting means and protective housing, it should be understood that the various embodiments can be interchanged as desired to produce the device.

The anchor material may be any single or multi-component system that is capable of providing the necessary cured physical properties to handle heavy loads and repeated stress over a long period of time. Examples include, but are not limited to, structural polyurethane foam, thermoset plastics, polyester, foamed polymer concrete or modifications or combinations thereof. A preferred formulation of the anchor material is structural polyurethane foam with a density of 30 pounds per cubic foot in combination with non-elastic spheres. Preferably, the spheres are ceramic spheres, present at a concentration between 10% and 30% by volume. The diameter of the ceramic spheres is preferably from 0.005 inches to 0.008 inches. However, the composition, concentration percentage and diameter of ceramic spheres can be varied depending on the desired cured physical characteristics of the anchor material. The structural polyurethane foam described above is a two component system and generally requires 10 to 15 minutes to cure. A properly cured structural polyurethane foam anchor point can withstand over 300 pounds of screw pulling force. This force meets or exceeds the force that can be withstood by traditional blocking methods and materials, such as wood.

The device is simple to use in operation, as illustrated in FIG. 3. FIG. 3 shows the device illustrated in FIGS. 1A and 1B. At any point in a wall requiring an anchor point, the user drills a hole 66 at the desired location in the wall 60. In most applications for home use, a ½ inch hole is sufficient for operation of the device. The user then inserts the device 10 into the hole 66. As shown in FIG. 3, the first end 24 of the housing 22 is inserted into the hole 66. The stop 32 engages the outer surface of the wall 60 and stops the insertion of the device 10 at the proper point. Optional snap anchors 70 engage the interior side of wall 60 in response to the back pressure generated by the inflation of bladder 16 and prevent the device 10 from backing out of hole 66. Once the device 10 is position in the hole 66, it is ready for use. The user initiates the flow of anchor material 62 by engaging the activation means, in this case depressing valve 52. Once activated, anchor material 62 flows from the at least one storage compartment 46 through the discharge tube 44, into and through the insertion tube 12 and into the bladder 16. If static mixing elements 45 are employed, the anchor material 62 is mixed as it travels through from the source 20 to the bladder 16. The anchor material 62 expands the bladder 16 to its maximum volume while leaking from the pre-engineered adhesion points 38 in the bladder 16. The anchor material 62 engages the back surface of the wall 60 and other structures contained within the interior 64 of the wall to form the anchor point. As discussed above, the size of the anchor point will depend on the volume of the bladder 16 and the amount of anchor material 62 used. These parameters may be altered to suit specific applications.

The anchor material is allowed to cure for 10 to 30 minutes. Once the curing process is complete the anchor point is ready for use. As the device 10 is still inserted into the hole, the user applies a slight lateral pressure to the device on the outer wall 28. This pressure causes the device 10 to snap along the preformed notches 34. The device 10 from the stop 32 to the second end 26 is then removed from the wall 60. The result is a flush surface that is ready for sanding, priming and painting or other finishing. Alternatively, if finishing the wall is not desired, the unfinished area of the wall created by the use of the device 10 is so small, the article may be mounted so that the unfinished area is covered by the article.

The anchor point created by the device and method of the present disclosure has many advantages over the blocking methods of the prior art. First, pound for pound the anchor point formed according to the present disclosure is stronger than the strongest of the blocking methods in current use. Second, the installation of the anchor point formed according to the present disclosure is simpler to install and requires minimal destruction of the wall surface to be reinforced. Current blocking methods require a large hole to be cut into the finished wall sufficient to expose two frame members. A section of wood must then be nailed to the frame members to block or reinforce the wall section. Finally, the finished wall must be replaced and finished. In contrast, the anchor point formed according to the present disclosure only requires the drilling of a small hole in the wall, without the need for extensive replacement and finishing. Third, when installation and repair costs are factored in, the anchor point formed by the present disclosure is up to $200 to $300 less expensive than current blocking methods. The result of the device and method described above is a reinforced area in the wall that is capable of securing heavy articles over long period s of time without causing damage to the wall.

The above discussion has described several embodiments of the device in detail so that the device and its principles of operation may be understood. The above discussion should not be interpreted to exclude additional embodiments of the device. With respect to the above description, it should be considered that the optimal dimensional relationships for the various parts of the invention, including variations in size, materials, shape, form, function and manner of operation, assembly and use, are readily apparent to one of ordinary skill in the art, and all equivalent relationships to those described above and illustrated in the figures are intended to be encompassed by the present disclosure. Therefore, the foregoing is considered illustrative only, and should not be understood to limit the scope of the disclosure to the exact construction and operation discussed and illustrated.

What is claimed:

1. A device for adding structural support to a wall, the device comprising:

a. an inflatable bladder, the bladder having at least one adhesion point along its periphery;

b. a source of anchor material; and c. a connecting means for fluidly connecting the bladder to the source of anchor material;

d. an activating means for activating a flow of anchor material from the source to the bladder so that at least a portion of the flow of anchor material will exit the at least one adhesion point, the activating means being operationally coupled to the device.

2. The device of claim 1 further comprising a housing, the housing further comprising a frangible first end and a second end, the first end and the second end being joined by an outer wall, a stop located a predetermined distance from the first end and a means for breaking located on the side of the stop proximal to the first end, the bladder being at least partially contained within a cavity formed by the first end, the second end and the outer wall.

3. The device of claim 2 where the outer wall further comprises an interior surface and an exterior surface and the moans for breaking is a notch in the outer and inner surfaces of the outer wall, the notch extending at least partially around the outer wall.

4. The device of claim 1 where the source of anchor material comprises:

a. at least one anchor material component chamber; and b. at least one propellant chamber;

the at least one anchor material component chamber and propellant chamber being in fluid communication with one another.

5. The device of claim 4 where the connecting means comprises an insertion tube having a first end and a second end, the insertion tube adapted to be fluidly coupled to the bladder on its first end and fluidly connected to the discharge tube on its second end, and a discharge tube having a first end and a second end, the discharge tube adapted to be fluidly coupled to the source of anchor material on its first end and fluidly connected to the insertion tube on its second end.

6. The device of claim 5 where the insertion tube and/or the discharge tube contain a plurality of mixing elements.

7. The device of claim 1 where the source of anchor material is a portable, self-contained unit comprising:

a. a plurality of anchor material component chambers; and b. a frangible separation means separating the plurality of anchor material component chambers the plurality of anchor material component chambers being in fluid contact with each other once the frangible separation means is broken.

8. The device of claim 7 where the connecting means is a discharge tube having a first end and a second end, the discharge tube adapted to be fluidly coupled to the source of anchor material on its first end and fluidly connected to the bladder on its second end, the frangible separation means is an O-ring comprising a frangible inner ring and a non-frangible center portion, and the activating means is a coupling shaft operationally linked to the non-frangible center portion.

9. The device of claim 1 where the anchor material is a structural polyurethane foam containing a plurality of non-elastic spheres.

10. The device of claim 9 where the concentration of non-elastic spheres is in the range of 10% to 30% by volume.

11. The device of claim 10 where the non-elastic spheres are manufactured from a ceramic material.

12. The device of claim 1 where the anchor material is a single or multi-component system and is selected from the group consisting of: foamed polyester, polyurethane, structural polyurethane foam, foamed polymer concrete and solid unformed polyurethane.

13. A method for adding structural support to a wall, the method comprising the steps of:

a. inserting a device essentially as described in claim 3 at least partially into an insertion hole in a wall such that the insertion of the device is halted by a stop;

b. engaging an activating means on the device to initiate a discharge of the anchor material from a source to a bladder at a sufficient pressure and speed that the anchor material causes the bladder to expand so that the anchor material will flow out of at least one adhesion point on the bladder and engage structures behind the wall;

c. allowing the anchor material to cure;

d. removing at least a portion of the device from the insertion hole, so that the surface of the wall is generally flush with the insertion hole.

14. The method of claim 13 where the device is removed from the hole by applying pressure to the housing at a pre-engineered breaking means.

15. The method of claim 13 where the device is essentially as described in claim 8.

* * * * *